US008944352B2

(12) United States Patent
Bausch et al.

(10) Patent No.: US 8,944,352 B2
(45) Date of Patent: Feb. 3, 2015

(54) PROCESS AND APPARATUS FOR PRODUCING CELL CULTURE MEDIA

(75) Inventors: Jochen Bausch, Breuberg (DE); Joerg von Hagen, Pfungstadt (DE); Tanino Scaramuzza, Hoechst (DE)

(73) Assignee: Merck Patent GmbH, Darmstadt (DE)

( * ) Notice: Subject to any disclaimer, the term of this patent is extended or adjusted under 35 U.S.C. 154(b) by 526 days.

(21) Appl. No.: 13/288,338

(22) Filed: Nov. 3, 2011

(65) Prior Publication Data

US 2013/0112786 A1 May 9, 2013

(51) Int. Cl.
*B02C 11/08* (2006.01)
*B02C 21/00* (2006.01)
*B02C 19/18* (2006.01)

(52) U.S. Cl.
CPC ..... *B02C 19/186* (2013.01)
USPC ..... 241/5; 241/23

(58) Field of Classification Search
USPC ..... 241/5, 23, DIG. 37
See application file for complete search history.

(56) References Cited

U.S. PATENT DOCUMENTS

| | | | | |
|---|---|---|---|---|
| 4,588,134 | A * | 5/1986 | Shimizu et al. | 241/21 |
| 7,900,857 | B2 * | 3/2011 | Medoff | 241/23 |
| 8,074,906 | B2 * | 12/2011 | Talton | 241/5 |
| 2008/0029625 | A1 * | 2/2008 | Talton | 241/21 |
| 2010/0012756 | A1 * | 1/2010 | Medoff | 241/23 |

* cited by examiner

*Primary Examiner* — Faye Francis
(74) *Attorney, Agent, or Firm* — Millen, White, Zelano & Branigan, P.C.

(57) ABSTRACT

The present invention relates to an apparatus and a process for manufacturing cell culture media. A specific cooling in combination with a certain type of mill lead to a production process that reduces decrease in the performance of the culture media. Preferably, the process is run continuously.

6 Claims, 1 Drawing Sheet

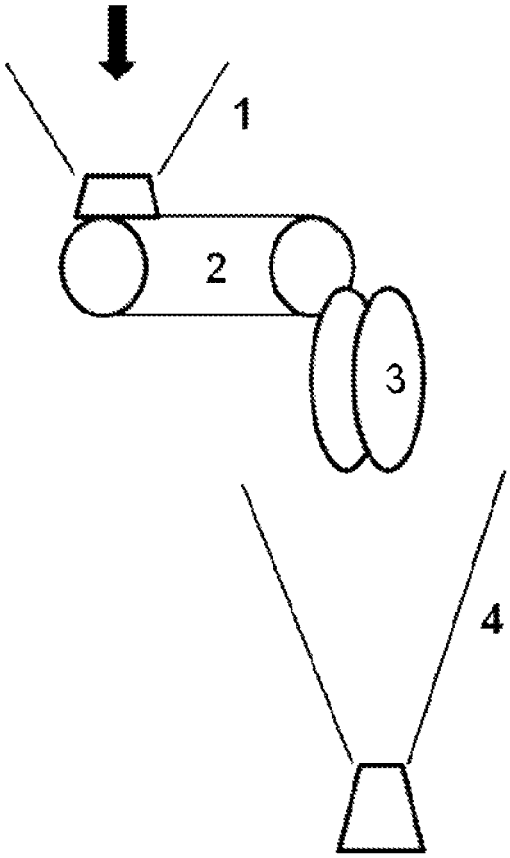
1
2
3
4

PROCESS AND APPARATUS FOR PRODUCING CELL CULTURE MEDIA

The present invention relates to an apparatus and a process for manufacturing cell culture media. A specific cooling in combination with a certain type of mill leads to a production process that reduces decrease in the performance of the culture media. Preferably the process is run continuously.

BACKGROUND OF THE INVENTION

Cell culture media support and maintain the growth of cells in an artificial environment.

Depending on the type of organism whose growth shall be supported, the cell culture media comprise a complex mixture of components, sometimes more than one hundred different components.

The culture media required for the propagation of mammalian, insect or plant cells are typically much more complex than the media to support the growth of bacteria and yeasts.

The first cell culture media that were developed consisted of undefined components, such as plasma, serum, embryo extracts, or other non-defined biological extracts or peptones. A major advance was thus made with the development of chemically defined media. Chemically defined media often comprise but are not exclusively limited to amino acids, vitamins, metal salts, antioxidants, chelators, growth factors, buffers, hormones, and many more substances known to those expert in the art.

Some cell culture media are offered as sterile aqueous liquids. The disadvantage of liquid cell culture media is their reduced shelf life and difficulties for shipping and storage. As a consequence, many cell culture media are presently offered as finely milled dry powder mixtures. They are manufactured for the purpose of dissolving in water and/or aqueous solutions and in the dissolved state are designed, often with other supplements, for supplying cells with a substantial nutrient base for growth and/or production of biopharmaceuticals from same said cells.

The production of cell culture media in the form of powders is very critical. Powdered media are typically produced by admixing the dried components of the culture medium via a mixing process, e.g., ball-milling, or by lyophilizing premade liquid culture medium. However, in a lyophilisation process some of the components of the medium might become insoluble or aggregate upon lyophilization such that resolubilization is difficult or impossible. Furthermore, when using a milling process, many of the ingredients used in culture media, e.g., L-glutamine and FBS, cannot be added to the culture medium prior to the milling process due to their sensitivity to shearing by processes such as ball-milling. Furthermore, many of these supplements, particularly serum supplements such as FBS, show a substantial loss of activity due to too much energy transfer (heat) or oxidation during milling. This leads to a decrease of the overall performance of the cell culture medium produced.

Consequently, there exists a clear need for finding an improved process for manufacturing powdered cell culture media that does not have the disadvantages mentioned above.

BRIEF DESCRIPTION OF THE INVENTION

It has been found that powdered cell culture media can be produced under very mild conditions so that less decrease of overall performance of the media is observed. This is achieved by using a certain type of mill, e.g. a pin mill, instead of a ball mill in combination with freezing the ingredients of the medium prior to milling.

The present invention is thus directed to a process for manufacturing cell culture media by a) providing the ingredients of the cell culture medium b) freezing the ingredients by cooling them to a temperature below 0° C.

c) milling the ingredients from step b) in a pin mill, fitz mill or a jet mill

In a preferred embodiment, the freezing in step b) is done by treating the ingredients with liquid nitrogen.

In a preferred embodiment, in step c) the milling is performed in an inert atmosphere.

In a preferred embodiment, in step c) the milling is done with a pin mill.

In a preferred embodiment, the ingredients are continuously fed to the mill.

In a preferred embodiment, in step b) the ingredients are freezed in a feeder.

In another embodiment, the ingredients provided in step a) comprise a poloxamer.

The present invention is further directed to an apparatus for producing milled powdered cell culture media comprising a) a feeder b) a means for introducing liquid nitrogen to the feeder c) a pin mill or a fitz mill or a jet mill d) a means for flowing inert gas in the mill In a preferred embodiment, the apparatus comprises a pin mill.

In another preferred embodiment, the apparatus also comprises a mixer connected to the outlet of the mill.

In one preferred embodiment, the feeder is a metering screw feeder.

DESCRIPTION OF THE INVENTION

FIG. 1 shows a schematic view of the apparatus according to the present invention.

A cell culture medium according to the present invention is any mixture of components which maintains and/or supports the in vitro growth of cells. It might be a complex medium or a chemically defined medium. The cell culture medium can comprise all components necessary to maintain and/or support the in vitro growth of cells or only some components so that further components are added separately. Examples of cell culture media according to the present invention are full media which comprise all components necessary to maintain and/or support the in vitro growth of cells, media supplements or feeds. In a preferred embodiment the cell culture medium is a full medium.

Typically, the cell culture media according to the invention are used to maintain and/or support the growth of cells in a bioreactor.

A mammalian cell culture medium is a mixture of components which maintain and/or support the in vitro growth of mammalian cells. Examples of mammalian cells are human or animal cells, preferably CHO cells, COS cells, I VERO cells, BHK cells, AK-1 cells, SP2/0 cells, L5.1 cells, hybridoma cells or human cells.

Chemically defined cell culture media are cell culture media that do not comprise any chemically undefined substances. This means that the chemical composition of all the chemicals used in the media is known. The chemically defined media do not comprise any yeast, animal or plant tissues; they do not comprise feeder cells, serum, extracts or digests or other components which may contribute chemically poorly defined proteins to the media. Chemically undefined or poorly defined chemical components are those whose chemical composition and structure is not known, are present in varying composition or could only be defined with enormous experimental effort—comparable to the evaluation of the chemical composition and structure of a protein like albumin or casein.

Cells to be cultured with the media according to the present invention may be prokaryotic cells like bacterial cells or eukaryotic cells like plant or animal cells. The cells can be normal cells, immortalized cells, diseased cells, transformed cells, mutant cells, somatic cells, germ cells, stem cells, precursor cells or embryonic cells, any of which may be established or transformed cell lines or obtained from natural sources.

The size of a particle means the mean diameter of the particle. The particle diameter is determined by laser light scattering in silicone oil.

An inert atmosphere is generated by filling the respective container or apparatus with an inert gas. Suitable inert gases are noble gases like argon or preferably nitrogen. These inert gases are non-reactive and prevent undesirable chemical reactions from taking place. In the process according to the present invention, generating an inert atmosphere means that the concentration of oxygen is reduced below 10% (v/v) absolute, e.g. by introducing liquid nitrogen or nitrogen gas.

Different types of mills are known to a person skilled in the art.

A pin mill, also called centrifugal impact mill, pulverizes solids whereby protruding pins on high-speed rotating disks provide the breaking energy.

Pin mills are for example sold by Munson Machinery (USA), Premium Pulman (India) or Sturtevant (USA).

A jet mill uses compressed gas to accelerate the particles, causing them to impact against each other in the process chamber. Jet mills are e.g. sold by Sturtevant (USA) or PMT (Austria).

A fitz mill commercialized by Fitzpatrick (USA), uses a rotor with blades for milling.

A process that is run continuously is a process that is not run batchwise. If the process according to the present invention is run continuously or semi-continuously it means that the media ingredients are permanently and steadily fed into the apparatus of the present invention over a certain time.

According to the present invention a feeder is a means that is suitable to transport the particulate ingredients to the mill. Examples of suitable feeders are screw conveyors, conveyor belts or metering screw feeders. Preferred is an extrusion-type screw feeder or conveyor section used to feed material at a constant rate. Especially preferred feeders are metering screw feeders which are sometimes also called dosage snail or dosing screw.

The cell culture media which are manufactured according to the method of the present invention typically comprise at least one or more saccharide components, one or more amino acids, one or more vitamins or vitamin precursors, one or more salts, one or more buffer components, one or more co-factors and one or more nucleic acid components.

The media may also comprise sodium pyruvate, insulin, vegetable proteins, fatty acids and/or fatty acid derivatives and/or pluronic acid and/or surface active components like chemically prepared non-ionic surfactants. One example of a suitable non-ionic surfactant are difunctional block copolymer surfactants terminating in primary hydroxyl groups also called poloxamers, e.g. available under the trade name Pluronic® from BASF, Germany.

Saccharide components are all mono- or di-saccharides, like glucose, galactose, ribose or fructose (examples of monosaccharides) or sucrose, lactose or maltose (examples of disaccharides).

Examples of amino acids according to the invention are the proteinogenic amino acids, especially the essential amino acids, leucine, isoleucine, lysine, methionine, phenylalanine, threonine, tryptophane and valine, as well as the non-proteinogenic amino acids like D-amino acids.

Examples of vitamins are Vitamin A (Retinol, retinal, various retinoids, and four carotenoids), Vitamin $B_1$ (Thiamine), Vitamin $B_2$ (Riboflavin), Vitamin $B_3$ (Niacin, niacinamide), Vitamin $B_5$ (Pantothenic acid), Vitamin $B_6$ (Pyridoxine, pyridoxamine, pyridoxal), Vitamin $B_7$ (Biotin), Vitamin $B_9$ (Folic acid, folinic acid), Vitamin $B_{12}$ (Cyanocobalamin, hydroxycobalamin, methylcobalamin), Vitamin C (Ascorbic acid), Vitamin D (Ergocalciferol, cholecalciferol), Vitamin E (Tocopherols, tocotrienols) and Vitamin K (phylloquinone, menaquinones). Vitamin precursors are also included.

Examples of salts are components comprising inorganic ions such as bicarbonate, calcium, chloride, magnesium, phosphate, potassium and sodium or trace elements such as Co, Cu, F, Fe, Mn, Mo, Ni, Se, Si, Ni, Bi, V and Zn. Examples are Copper(II) sulphate pentahydrate ($CuSO_4.5H_2O$), Sodium Chloride (NaCl), Calcium chloride ($CaCl_2.2H_2O$), Potassium chloride (KCl), Iron(II)sulphate, sodium phosphate monobasic anhydrous ($NaH_2PO_4$), Magnesium sulphate anhydrous ($MgSO_4$), sodium phosphate dibasic anhydrous ($Na_2HPO_4$), Magnesium chloride hexahydrate ($MgCl_2.6H_2O$), zinc sulphate heptahydrate.

Examples of buffers are $CO_2/HCO_3$ (carbonate), phosphate, HEPES, PIPES, ACES, BES, TES, MOPS and TRIS.

Examples of cofactors are thiamine derivatives, biotin, vitamin C, NAD/NADP, cobalamin, flavin mononucleotide and derivatives, glutathione, heme nucleotide phophates and derivatives.

Nucleic acid components, according to the present invention, are the nucleobases, like cytosine, guanine, adenine, thymine or uracil, the nucleosides like cytidine, uridine, adenosine, guanosine and thymidine, and the nucleotides like adenosine monophosphate or adenosine diphosphate or adenosine triphosphate.

Freezing according to the present invention means cooling to a temperature below 0° C.

The gist of the present invention is to provide an apparatus and a process which enable the production of high quality powdered cell culture media which are milled in a very gentle way so that there is almost no loss of performance due to instability/destruction of certain ingredients during the milling process.

The process is based on the use of certain types of mills, like a pin mill, a fitz mill or a jet mill in combination with freezing of the ingredients prior to the milling.

The freezing of the ingredients prior to the milling can be done by any means that ensures a cooling of the ingredients to a temperature below 0° C. and most preferably below −20° C. In a preferred embodiment the freezing is done with liquid nitrogen. This means the ingredients are treated with liquid nitrogen, for example by pouring liquid nitrogen into the container in which the ingredients are stored prior to introduction into the mill. In a preferred embodiment, the container is a feeder. If the container is a feeder the liquid nitrogen is preferably introduced at the side or close to the side of the feeder at which the ingredients are introduced.

Typically the ingredients are treated with the liquid nitrogen over 2 to 20 seconds.

Preferably the cooling of the ingredients is done in a way that all ingredients that enter into the mill are at a temperature below 0° C., most preferred below −20° C.

Before treating the ingredients with liquid nitrogen all ingredients are pre-mixed. Preferably, all components are thoroughly mixed so that all parts of the mixture have nearly the same composition. The higher the uniformity of the composition, the better the quality of the resulting medium with respect to homogenous cell growth.

In a preferred embodiment, all ingredients are put in a container from which the mixture is transferred in a feeder, most preferred in a metering screw feeder. In the feeder the ingredients are sometimes further mixed—depending on the type of feeder—and additionally cooled. The freezed mixture is then transferred from the feeder to the mill so that the mixture which is milled in the mill preferably still has a temperature below 0° C., more preferred below −20° C.

Typically the blending time, that means the residence time of the mixture of ingredients in the feeder is more than one minute, preferably between 15 and 60 minutes.

A metering screw feeder, also called dosage snail, is typically run at a speed of 10 to 200 revolutions per minute, preferably it is run at 40 to 60 revolutions per minute.

Typically, the temperature of the mill is kept between −50 and +30° C. In a preferred embodiment, the temperature is kept around 10° C.

The oxygen level during milling preferably is below 10% (v/v).

A large scale equipment mill with a disc diameter of about 40 cm is e.g. typically run at 1-6500 revolutions per minute in case of a pin mill, preferred are 1-3000 revolutions per minute.

The milling can be done under standard milling conditions resulting in powders with particle sizes between 10 and 300 μm, most preferably between 25 and 100 μm.

Preferably, all components of the mixture are dry. This means, if they comprise water, they do only comprise water of crystallization but not more than 10%, preferably not more than 5% most preferred not more than 2% by weight of unbound or uncoordinated water molecules.

In a preferred embodiment, the milling is performed in an inert atmosphere. Preferred inert protective gas is nitrogen.

The process can be run batch-wise or continuously. In a preferred embodiment the process according to the present invention is done continuously or semi-continuously by, over a certain time, permanently filling the mixture of ingredients into a feeder for cooling and permanently filling cooled mixture from the feeder into the mill.

The apparatus according to the present invention comprises at least a) a feeder b) a means for introducing liquid nitrogen to the feeder c) a pin mill or a fitz mill or a jet mill d) a means for feeding inert gas into the mill.

In a preferred embodiment, the apparatus comprises a pin mill.

Typically, a container, e.g. in form of a funnel, is connected to the feeder to achieve that the premixed ingredients can be filled from the container into the feeder. In a preferred embodiment, this is done continuously over a certain time to enable a continuous milling process.

In one embodiment, the apparatus also comprises one or more sieves and/or a mixer. The sieves can be used for sizing the powder that comes out of the mill. The mixer can be used to additionally homogenize the milled powder.

A person skilled in the art knows which feeders and mills are suitable for use in an inert atmosphere. Typically, suitable feeders and mills are equipped with seals and valves for the introduction of inert gas. The feeders are preferably also equipped with valves or other means for the introduction of liquid nitrogen.

FIG. 1 gives a schematic view of one possible apparatus according to the present invention.

The ingredients of the cell culture medium that are to be milled are introduced into funnel 1. From funnel 1 they are filled into feeder 2. Feeder 2 is equipped with a means to introduce liquid nitrogen (not shown). From feeder 2 the cooled ingredients are introduced in mill 3. The milled media composition is collected in mixer 4. The milled cell culture medium can be taken from the apparatus at the outlet of mixer 4.

The milled powdered cell culture media finally coming out of the apparatus of the present invention can then be further processed. The medium can be packaged and/or sterilized. Suitable containers are known to a person skilled in the art. Examples are bags, boxes, bottles, cartons, vacuum-packed forms etc. The packaging can be performed prior or after sterilization. Preferred is gamma-irradiation after appropriate packaging.

Typically, the media resulting from the process according to the present invention have the following specifications:

- off-white to coloured powder depending on ingredients used
- moisture content below or equal to 5% by weight
- solubility: clear solution at 1× concentration
- pH between 4.20 and 8.30
- osmolality (mOsm/kg $H_2O$) between 225-385 at 1× concentration It has been found that in contrast to other milling processes the process and the apparatus according to the present invention offer the possibility to mill mixtures that comprise ingredients such as cytokines which are instable under standard milling conditions using a ball mill e.g. because under these conditions the ingredients are subjected to elevated temperatures during milling.

It has also been found that ingredients that could not be milled due to their consistency or texture as part of a cell culture medium before, can be milled with the process according to the present invention. These are e.g. elastic materials like polymers or elastic platelets, long crystals or substances that are not solid like fats. For example, polymeric particles which are sometimes added to the media were typically added to the media after milling as the particles could not be milled. The process of the present invention allows the milling of mixtures comprising polymeric particles. Poloxamers like Pluronic (R) from BASF (Germany) are an example of polymers that can be added to the mixture and milled according to the process according to the present invention.

It has further been found that compared to known milling processes using a ball mill, the process according to the present invention results in more homogenous culture media that show less decrease of overall performance. It is assumed that the cooling prior to the milling makes the ingredients harder and more brittle so that they can be milled better. The pin mill has be found to be the mill of choice to use in this process as it shows especially homogenous results.

For use of the milled powdered media a solvent, preferably water (most particularly distilled and/or deionized water or purified water or water for injection) or an aqueous buffer is added to the media and the components are mixed until the medium is totally dissolved in the solvent.

The solvent may also comprise saline, soluble acid or base ions providing a pH range of 1.0-10.0, stabilizers, surfactants, preservatives, and alcohols or other polar organic solvents.

It is also possible to add further substances like buffer substances for adjustment of the pH, fetal calf serum, sugars etc., to the mixture of the cell culture medium and the solvent. The resulting liquid cell culture medium is then contacted with the cells to be grown or maintained.

The present invention is further illustrated by the following figure and example, however, without being restricted thereto.

The entire disclosure of all applications, patents, and publications cited above and below are hereby incorporated by reference.

EXAMPLES

The following examples represent practical applications of the invention.

1. Milling of Dulbecco's Modified Eagle Medium DMEM

Dulbecco's Modified Eagle Medium, also known as DMEM, is a medium often used for growing animal cells. The ingredients of DMEM are in mg/l:

Inorganic Salts:
$CaCl_2$ (anhydrous): 200.00
$Fe(NO_3).9H_2O$: 0.10
KCl: 400.00
$MgSO_4$ (anhydrous): 97.67
NaCl: 6400.00
$NaH_2PO_4.H_2O$: 125.00

Other Components:
D-Glucose: 4500.00
Phenol red: 15.00
Sodium pyruvate: 110.00

Amino Acids:
L-Arginin. HCl: 84.00
L-Cystine.2HCl: 63.00
L-Glutamine: 584.00
Glycine: 30.00
L-Histidine HCl $H_2O$: 42.00
L-Isoleucin: 105.00
L-Leucine: 105.00
L-Lysin HCl: 146.00
L-Methionine: 30.00
L-Phenylalanine: 66.00
L-Serine: 42.00
L-Threonine: 95.00
L-Tryptophane: 16.00
L-Tyrosine $2Na.2H_2O$: 104.33
L-Valine: 94.00

Vitamins:
D-Calciumpantothenate: 4.00
Cholin chloride: 4.00
Folic acid: 4.00
i-Inositol: 7.20
Niacinamide: 4.00
Riboflavine: 0.40
Thiamine.HCl: 4.00

All ingredients of the DMEM medium are mixed, entered into the apparatus according to the present invention comprising a dosage snail and a pin mill. In the dosage snail the ingredients are treated with liquid nitrogen.

As apparatus is run under the following conditions:
Temperature—mill: 10° C.
Oxygen level: below 10% absolute
Rpm—Mill: up to 2800 1/min
Blending time: 30 min
Rpm dosage snail: 40 1/min The resulting powdered cell culture medium is suitable for the culture of CHO (Chinese Hamster Ovary) cells.

We claim:

1. A process for manufacturing cell culture media comprising a) providing the ingredients of the cell culture medium;

b) cooling the ingredients of step a) to a temperature below 0° C.; and c) milling the ingredients from step b) in a pin mill.

2. The process of claim 1, comprising treating the ingredients with liquid nitrogen in the cooling step b).

3. The process of claim 1, comprising milling the ingredients in step c) in an inert atmosphere.

4. The process of claim 1, comprising continuously feeding the ingredients to the mill in step c).

5. The process of claim 1, wherein in step b) the ingredients are cooled in a feeder.

6. The process of claim 1, wherein the ingredients provided in step a) comprise a poloxamer.

* * * * *